US010472753B2

(12) United States Patent
Shiraishi et al.

(10) Patent No.: US 10,472,753 B2
(45) Date of Patent: Nov. 12, 2019

(54) BOBBIN THREAD WINDER OF SEWING MACHINE AND SEWING MACHINE

(71) Applicant: JUKI CORPORATION, Tama-shi, Tokyo (JP)

(72) Inventors: Atsushi Shiraishi, Tama (JP); Nobuaki Kinoshita, Tama (JP); Kiyoshi Minami, Tama (JP)

(73) Assignee: JUKI CORPORATION, Tama-shi, Tokyo (JP)

( * ) Notice: Subject to any disclaimer, the term of this patent is extended or adjusted under 35 U.S.C. 154(b) by 72 days.

(21) Appl. No.: 15/806,706

(22) Filed: Nov. 8, 2017

(65) Prior Publication Data

US 2018/0127907 A1 May 10, 2018

(30) Foreign Application Priority Data

Nov. 9, 2016 (JP) ..... 2016-218533

(51) Int. Cl.
*D05B 59/02* (2006.01)

(52) U.S. Cl.
CPC ..... *D05B 59/02* (2013.01)

(58) Field of Classification Search
CPC ..... D05B 59/00; D05B 59/02; D05B 59/04; D05B 19/00; D05B 19/02
USPC ..... 112/278
See application file for complete search history.

(56) References Cited

U.S. PATENT DOCUMENTS 3,845,320 A * 10/1974 Winberg ..... D05B 59/02 112/278
4,681,050 A * 7/1987 Kosmas ..... D05B 59/02 112/180
4,732,098 A * 3/1988 Mertel ..... D05B 59/02 112/231
4,805,544 A * 2/1989 Dobner ..... D05B 59/02 112/231
5,078,331 A * 1/1992 Mardix ..... D05B 59/02 112/273
5,161,475 A * 11/1992 Tawara ..... D05B 59/02 112/278

(Continued)

FOREIGN PATENT DOCUMENTS

JP 2008-29381 A 2/2008

*Primary Examiner* — Nathan E Durham
(74) *Attorney, Agent, or Firm* — Drinker Biddle & Reath LLP

(57) ABSTRACT

A bobbin thread winder of a sewing machine including a bobbin winder spindle holding a bobbin and a driving mechanism to apply a drive force to the bobbin winder spindle, comprises a time measuring unit to measure an bobbin-thread winding execution time with respect to the bobbin, and a bobbin-thread winding amount calculating unit which calculates a winding amount of the bobbin based on the bobbin-thread winding execution time with respect to the bobbin measured by the time measuring unit. In the bobbin thread winder, since the bobbin-thread winding execution time was measured by the time measuring unit, and the bobbin winding amount of the bobbin is calculated based on the bobbin-thread winding execution time by the bobbin-thread winding amount calculating unit, it is possible to detect the bobbin winding amount of the bobbin accurately regardless of the type and thickness of the bobbin thread.

4 Claims, 6 Drawing Sheets

(56) References Cited

U.S. PATENT DOCUMENTS

| | | | | | |
|---|---|---|---|---|---|
| 5,211,121 | A * | 5/1993 | Sakakibara | D05B 59/02 | 112/278 |
| 5,322,029 | A * | 6/1994 | Fujita | D05B 59/02 | 112/278 |
| 5,353,726 | A * | 10/1994 | Bruder | B65H 67/063 | 112/278 |
| 5,651,324 | A * | 7/1997 | Arnold | D05B 59/02 | 112/278 |
| 5,839,679 | A * | 11/1998 | Katayama | D05B 59/04 | 242/476.1 |
| 6,092,478 | A * | 7/2000 | Simakrai | D05B 19/12 | 112/278 |
| 6,182,918 | B1 * | 2/2001 | Shinozuka | D05B 59/00 | 112/180 |
| 6,578,503 | B2 * | 6/2003 | Matsuzawa | D05B 19/12 | 112/102.5 |
| 6,810,824 | B2 * | 11/2004 | Durville | D05B 59/02 | 112/278 |
| 2003/0010270 | A1 * | 1/2003 | Hayashi | B65H 51/30 | 112/279 |
| 2004/0040482 | A1 * | 3/2004 | Fluckiger | B65H 63/082 | 112/278 |
| 2006/0213412 | A1 * | 9/2006 | Durville | D05B 59/02 | 112/278 |
| 2013/0167763 | A1 * | 7/2013 | Cho | D05B 59/00 | 112/278 |

* cited by examiner

FIG. 5

| OUTER DIAMETER OF THREAD WOUND AROUND BOBBIN [mm] | | | | | | | | | | | | | | | | | | | | |
|---|---|---|---|---|---|---|---|---|---|---|---|---|---|---|---|---|---|---|---|---|
| 25 | | | | | 30 | 35 | 42 | 49 | 56 | 62 | 72 | 78 | 84 | 90 | 93 | 104 | 110 | 113 | 121 | 127 |
| 24 | | | | | 29 | 34 | 42 | 49 | 55 | 61 | 70 | 76 | 83 | 88 | 91 | 101 | 107 | 109 | 117 | 122 |
| 23 | | | | 24 | 28 | 33 | 41 | 48 | 55 | 60 | 68 | 74 | 81 | 86 | 89 | 98 | 104 | 105 | 113 | 117 |
| 22 | | | 18 | 23 | 28 | 32 | 41 | 47 | 54 | 60 | 66 | 72 | 79 | 84 | 87 | 95 | 101 | 101 | 109 | 112 |
| 21 | | | 17 | 22 | 27 | 32 | 40 | 46 | 53 | 59 | 64 | 70 | 77 | 82 | 85 | 92 | 98 | 97 | | |
| 20 | | 11 | 17 | 22 | 26 | 31 | 40 | 46 | 52 | 58 | 62 | 68 | 75 | 80 | 83 | 89 | 95 | | | |
| 19 | 8 | 11 | 16 | 21 | 26 | 30 | 40 | 45 | 51 | 56 | 59 | 66 | 73 | 78 | 81 | | | | | |
| 18 | 8 | 10 | 16 | 21 | 25 | 30 | 39 | 44 | 51 | 55 | 57 | 64 | 71 | 76 | | | | | | |
| 17 | 7 | 10 | 15 | 20 | 25 | 29 | 37 | 43 | 50 | 53 | 55 | 62 | | | | | | | | |
| 16 | 7 | 10 | 15 | 20 | 24 | 29 | 36 | 42 | 49 | 51 | 53 | | | | | | | | | |
| 15 | 6 | 9 | 14 | 19 | 24 | 29 | 35 | 41 | 48 | 50 | | | | | | | | | | |
| 14 | 6 | 9 | 14 | 19 | 23 | 28 | 34 | 40 | | | | | | | | | | | | |
| 13 | 5 | 9 | 14 | 18 | 22 | 28 | 33 | | | | | | | | | | | | | |
| 12 | 5 | 7 | 13 | 17 | 21 | 27 | | | | | | | | | | | | | | |
| 11 | 4 | 7 | 12 | 16 | 20 | | | | | | | | | | | | | | | |
| 10 | 4 | 5 | 12 | 15 | | | | | | | | | | | | | | | | |
| | 5.0 | 7.5 | 10.0 | 12.5 | 15.0 | 17.5 | 20.0 | 22.5 | 25.0 | 27.5 | 30.0 | 32.5 | 35.0 | 37.5 | 40.0 | 42.5 | 45.0 | 47.5 | 50.5 | 52.5 |

BOBBIN-THREAD WINDING EXECUTION TIME [s]

BOBBIN THREAD WINDER OF SEWING MACHINE AND SEWING MACHINE

CROSS-REFERENCE TO RELATED APPLICATION

The present application claims the benefit of priority of Japanese Patent Applications No. 2016-218533, filed on Nov. 9, 2016, the disclosure of which is incorporated herein by reference.

TECHNICAL FIELD

The present invention relates to a bobbin thread winder used in a sewing machine and the sewing machine.

BACKGROUND ART

A bobbin thread winder which is mounted in a sewing machine includes a drive wheel coming in contact with a drive pulley equipped on an upper shaft of the sewing machine at an outer periphery thereof, a thread winding shaft rotating integrally with the drive wheel, a rotating arm rotatably supporting the thread winding shaft, a thread winding lever which is circumscribed the thread wound around a bobbin set in the thread winding shaft, a cam member rotating coaxially with the thread winding lever, and a cam follower which has a recessed portion to which a protrusion of the cam member is fitted and is integrally connected with the rotating arm (for example, see Japanese Unexamined Patent Application Publication No. 2008-29381).

In the above-described bobbin thread winder, a torque is transmitted from the upper shaft of the sewing machine to the bobbin set in the thread winding shaft through the drive pulley and the drive wheel. When the thread is wound around the bobbin, the thread winding lever gradually rotates in accordance with the winding amount. When the winding amount reaches a prescribed amount, the protrusion of the cam member is fitted to the recessed portion of the cam follower, the cam follower and the rotating arm rotate, and then the drive wheel is separated from the drive pulley, whereby the thread winding is finished.

However, the above-described bobbin thread winder merely uniformizes the outer diameter of the thread wound around the bobbin.

Therefore, since the winding amount of the thread wound around the bobbin varies depending on the type and thickness of the bobbin thread, it is not possible to grasp the winding amount of the bobbin thread accurately.

SUMMARY OF THE INVENTION

An object of the present invention is to enable to grasp the winding amount of the thread wound around the bobbin. The present invention has the following characteristics (1) to (4).

(1) A bobbin thread winder of a sewing machine including a bobbin winder spindle holding a bobbin and a driving mechanism to apply a drive force to the bobbin winder spindle, comprising:

a time measuring unit configured to measure an bobbin-thread winding execution time with respect to the bobbin; and a bobbin-thread winding amount calculating unit configured to calculate a winding amount of the bobbin based on the bobbin-thread winding execution time with respect to the bobbin measured by the time measuring unit.

(2) The bobbin thread winder of a sewing machine according to (1), further comprising:

a bobbin-thread outer diameter detecting unit configured to detect that an outer diameter of the thread wound around the bobbin held by the bobbin winder spindle reaches a prescribed size, wherein the bobbin-thread winding amount calculating unit configured to calculate a bobbin-thread winding amount of the bobbin based on the bobbin-thread winding execution time with respect to the bobbin during which the bobbin-thread outer diameter detecting unit detects that the outer diameter of the bobbin thread reaches the prescribed size.

(3) The bobbin thread winder of a sewing machine according to (1), further comprising:

a bobbin-thread outer diameter detecting unit configured to detect an outer diameter of the thread wound around the bobbin, wherein the bobbin-thread winding amount calculating unit configured to calculate a bobbin-thread winding amount of the bobbin based on the outer diameter of the thread wound around the bobbin detected by the bobbin-thread outer diameter detecting unit, and the bobbin-thread winding execution time with respect to the bobbin.

(4) The bobbin thread winder of a sewing machine according to (1), further comprising:

a bobbin-thread remaining amount calculating unit configured to calculate the amount of bobbin thread remaining on the bobbin based on the bobbin-thread winding amount of the bobbin calculated by the bobbin-thread winding amount calculating unit, and a stitch pitch set in advance.

In the bobbin thread winder of a sewing machine according to the present invention, since the bobbin-thread winding execution time with respect to the bobbin was measured by the time measuring unit, and the bobbin winding amount of the bobbin is calculated based on the bobbin-thread winding execution time with respect to the bobbin by the bobbin-thread winding amount calculating unit, it is possible to detect the bobbin winding amount of the bobbin accurately regardless of the type and thickness of the bobbin thread.

In addition, it is not necessary for a sewing worker to estimate the bobbin winding amount of the bobbin based on the outer diameter of the thread wound around the bobbin, the type, and the thickness of the bobbin thread, or to input the estimate value to the sewing machine. Accordingly, a workload of the sewing worker can be reduced.

BRIEF DESCRIPTION OF DRAWINGS

FIG. 5 is a table for explaining a relationship between an outer diameter of thread wound around the bobbin and a bobbin-thread winding execution time and bobbin winding amount.

DETAILED DESCRIPTION

Outline of Embodiment of Invention

Figure 1:
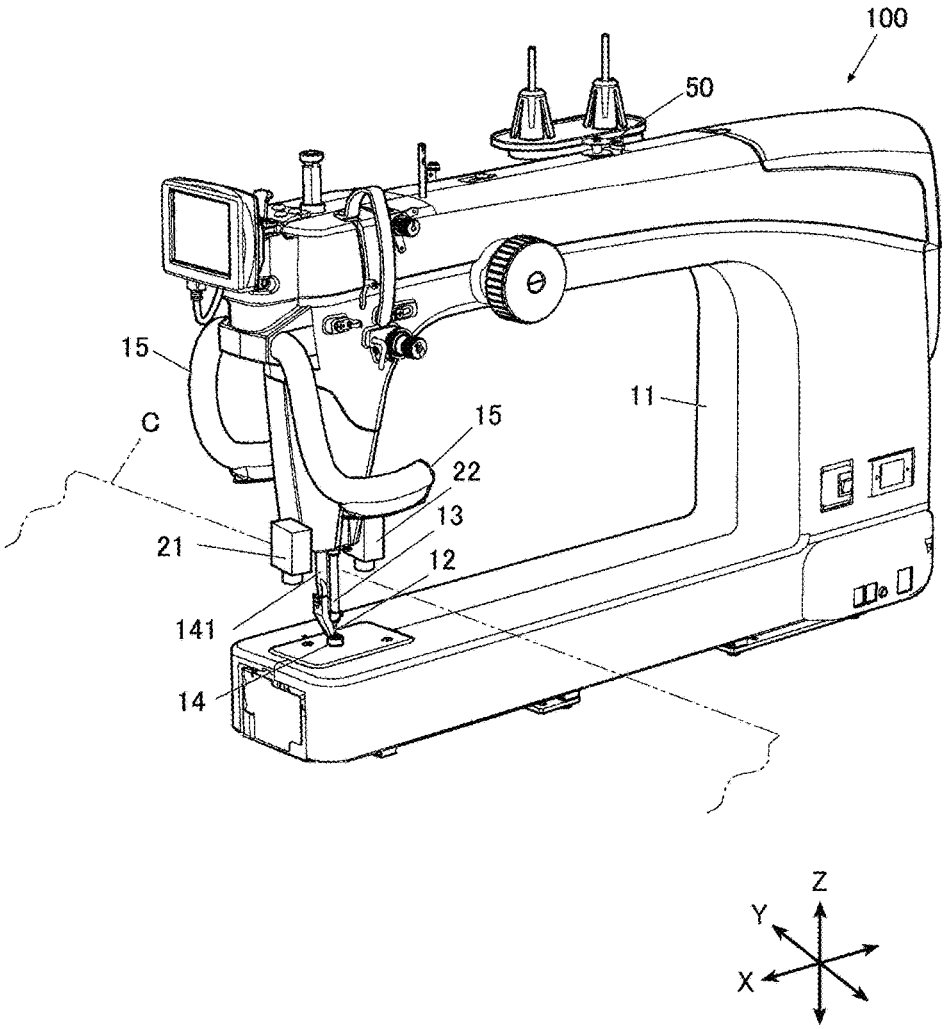
FIG. 1 is a perspective view illustrating a sewing machine an embodiment of the present invention.

Hereinafter, a sewing machine according to the embodiment of the present invention will be described with reference to the drawings. FIG. 1 is a perspective view illustrating a sewing machine 100.

Here, the sewing machine 100 of this embodiment is capable of performing so called free motion sewing in which a holding table, which holds cloth as a workpiece horizontally tightly, supports the sewing machine 100 to be movable arbitrarily along a horizontal plane, so that the sewing worker performs sewing on the cloth while arbitrarily moving the sewing machine 100.

In this embodiment, since it is the same as the known holding table, illustration of the holding table and description on the structure thereof will not be given.

The sewing machine 100 includes a needle bar vertical movement mechanism which vertically moves a needle bar 13 holding a sewing needle 12 at the lower end thereof, a shuttle mechanism which catches a needle thread passed through the sewing needle to entangle with the bobbin thread, a thread take-up lever mechanism which forms a knot by pulling up the needle thread, a thread tensioner for applying a predetermined tension to the needle thread, a fame 11 which stores or holds the aforementioned components, a bobbin thread winder 50 mounted with a bobbin B, which is empty, for winding the thread around the bobbin, and a controller 90 as a control unit for performing various operational controls.

Since the needle bar vertical movement mechanism, the shuttle mechanism, the thread take-up lever mechanism, thread tensioner, and the fame 11 described above are the same as known configurations of the sewing machine in the related art, description thereof will not be given in detail.

The frame 11 is configured to include a bed portion positioned at a lower portion of a main body, a vertical drum portion erected from one end of the bed portion, and an arm portion extending from the vertical drum portion in a direction toward the bed portion.

Hereinafter, in the description a direction which is a horizontal direction and extends along a longitudinal direction of the bed portion is defined as an X-axis direction, a direction which is a horizontal direction and is orthogonal to the X-axis direction is defined as a Y-axis direction, and a direction which is a vertical direction orthogonal to the X-axis direction and the Y-axis direction is defined as a Z-axis direction.

In addition, the sewing machine 100 includes a center presser foot 14 which presses cloth C so that the sewing needle 12 smoothly retreats from the cloth C at the time of rising. The center presser foot 14 is supported at a lower end of a center presser bar 141. In addition, the center presser foot 14 is a frame body which can loosely insert the sewing needle 12 therein, and obtains power from a motor 30 (refer to FIG. 4) which is a drive source to move the needle bar 13 vertically through a transmission mechanism in the related art, thereby moving vertically with a smaller amplitude than the needle bar 13. The center presser foot 14 is deviated from the needle bar 13 in phase, and is lowered when the sewing needle 12 rises. Further, the center presser foot 14 is set to have some clearance with respect to a throat plate at a bottom dead center position in order not to disturb the movement of the cloth C.

Figure 4:
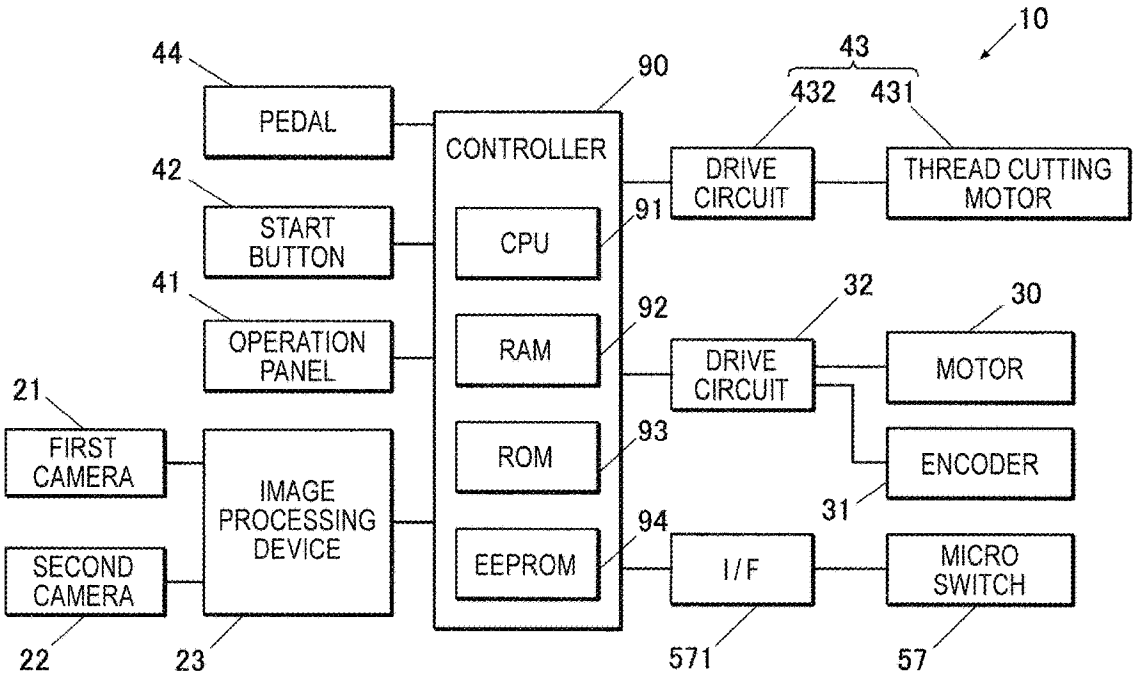
FIG. 4 is a block diagram illustrating a control system of the sewing machine.

The sewing machine 100 includes a thread cutting device 43 for cutting the sewing thread at the end of sewing, as illustrated in FIG. 4. The thread cutting device 43 includes a moving knife disposed below the throat plate and capable of reciprocating so as to pass through just below a pin hole, a fixed knife for cutting the sewing thread in cooperation with the moving knife (none of the knives shown), a thread cutting motor 431 for reciprocating the moving knife, and a drive circuit 432 for driving the thread cutting motor 431 according to an instruction from the controller 90.

In the sewing machine 100, first and second cameras 21 and 22 are provided around the needle bar 13. These cameras 21 and 22 are fixedly supported by the arm portion to face downward, and both of the cameras 21 and 22 are arranged such that the position of the stitch point (the pin hole) can be contained in the imaging ranges thereof.

Further, both of the first and second cameras 21 and 22 have optical axes in parallel to the Z-axis direction, and are arranged symmetrically with respect to a plane containing the center line of the needle bar 13 and the center line of the center presser bar 141.

Thus, when capturing an image on the cloth C on the throat plate, although the imaging ranges of the first and second cameras 21 and 22 are partially obstructed by the needle bar 13, the center presser foot 14, and the like, the obstructed range of one of the cameras 21 and 22 can be captured by the other of the cameras 21 and 22, whereby the whole periphery of the needle bar 13 can be captured complementarily.

Bobbin Thread Winder

Figure 2:
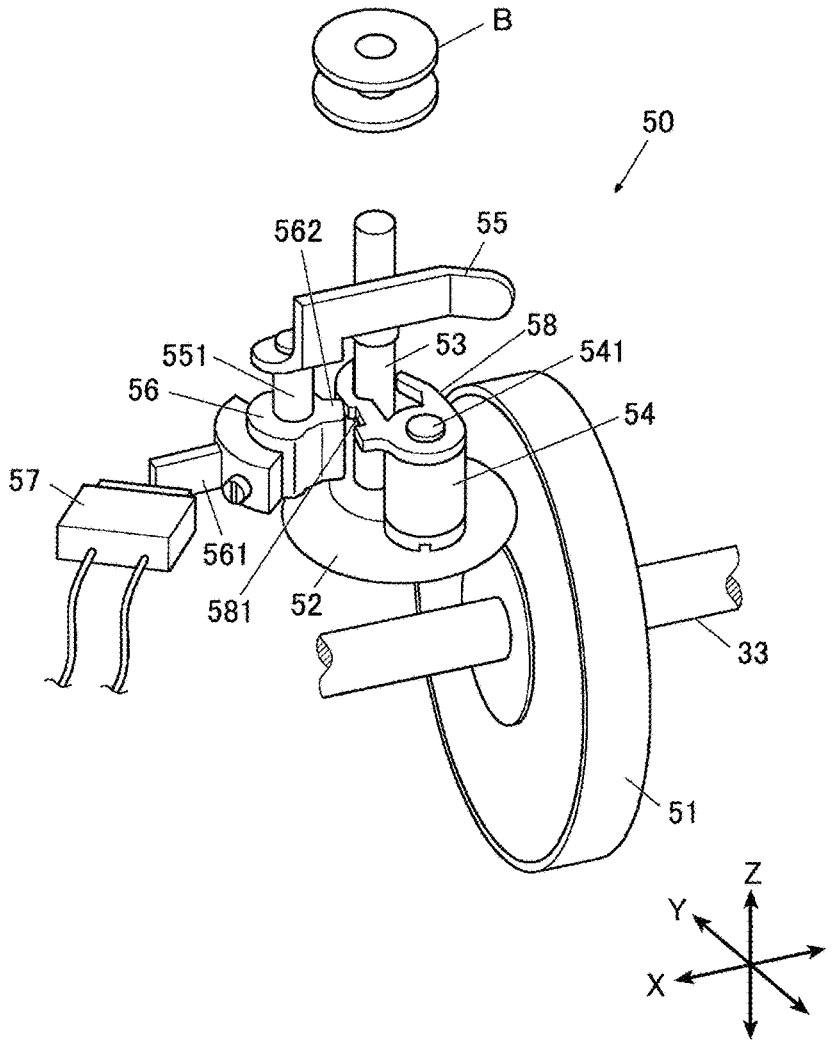
FIG. 2 is a perspective view illustrating a bobbin thread winder.
Figure 3A:
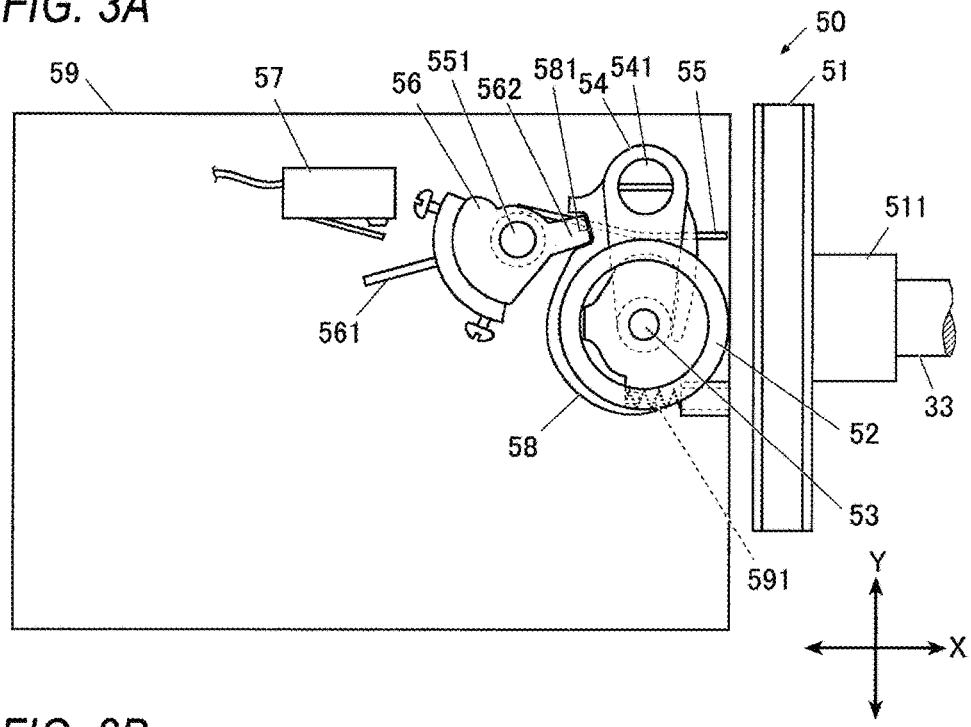
FIG. 3A is a bottom view of the bobbin thread winder in a state where bobbin-thread winding is not executed.
Figure 3B:
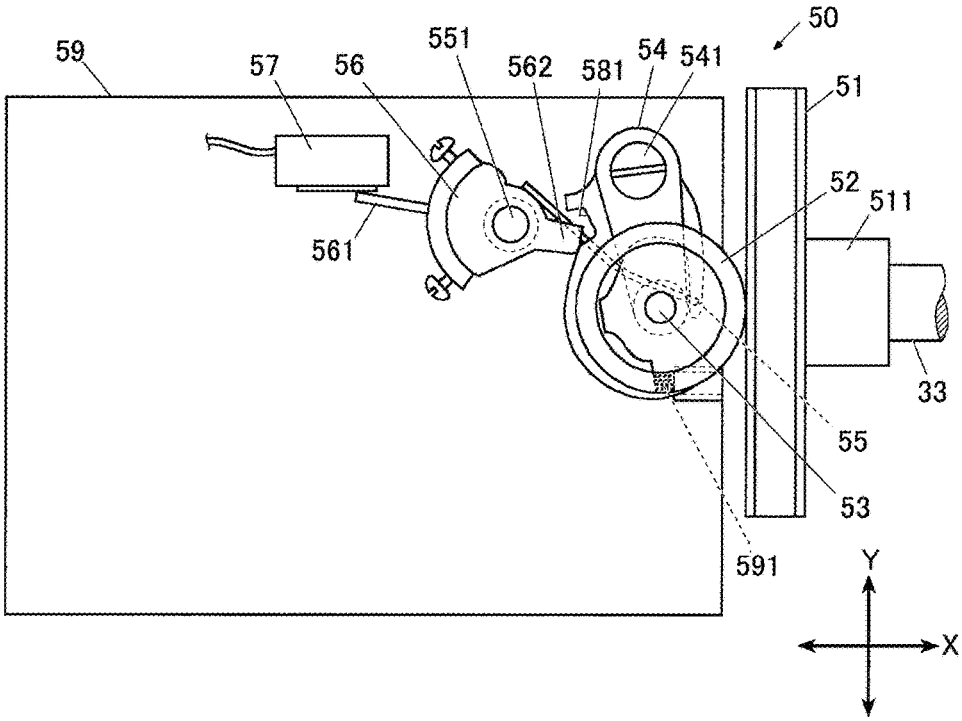
FIG. 3B is a bottom view of the bobbin thread winder in a state where the bobbin-thread winding is executed.

FIG. 2 is a perspective view illustrating a bobbin thread winder 50, and FIGS. 3A and 3B are bottom views of the bobbin thread winder 50 in a state before and after operation.

The bobbin thread winder 50 includes a drive pulley 51 equipped on a upper shaft 33 rotatably driven by the motor 30, a drive wheel 52 which comes in contact with the vicinity of the outer periphery of the drive pulley 51, a bobbin winder spindle 53 holding the bobbin B and rotating integrally with the drive wheel 52, a rotating arm 54 rotatably supporting the bobbin winder spindle 53, a detection lever 55 coming in contact with the outer periphery of the thread wound around the bobbin B held by the winding spindle 53, a rotating body 56 which rotates integrally with the detection lever 55, a micro switch 57 as a detection unit to detect a change in position of a detection piece 561 provided on the rotating body 56, a cam plate 58 which rotates integrally with the rotating arm 54, and a support plate 59 which supports respective configurations of the bobbin thread winder 50.

The drive pulley 51 has a flat disc shape and in the vicinity of the outer periphery of one flat surface thereof comes in contact with the outer periphery of the drive wheel 52 to apply a torque.

The drive pulley 51 is equipped on the upper shaft 33 extending along the X-axis direction through a one-way clutch 511. When the rotation of the upper shaft 33 at the time of stitching is set to a forward rotation, a torque is transmitted to the drive pulley 51 only in the case of reverse rotation of the upper shaft 33.

The bobbin winder spindle 53 is rotatably supported by the rotating arm 54 along the Z-axis direction. The upper end of the bobbin winder spindle 53 can hold the bobbin B in a state of being inserted into the center hole of the bobbin B, and a holding spring (not shown) is equipped on the upper end to bias the bobbin B so that the bobbin rotates together with the bobbin winder spindle 53.

In addition, the lower end of the bobbin winder spindle 53 is fixedly connected to the center portion of the drive wheel 52, and thus, the bobbin B, the bobbin winder spindle 53, and the drive wheel 52 rotate integrally around the Z axis.

The rotating arm 54 faces a direction almost along the Y-axis direction, and on end thereof is supported by the support plate 59 so as to rotate around a spindle 541 along the Z-axis direction. The other end of the rotating arm 54 supports the bobbin winder spindle 53 described above to be rotatable.

Accordingly, when the rotating arm 54 rotates around the spindle 541, the bobbin winder spindle 53 supported at the side of the end of the rotating arm moves along the X-axis direction, and the drive wheel 52 positioned on the lower end of the bobbin winder spindle 53 performs contacting and separating movement with respect to the drive pulley 51.

Therefore, the torque-cutting state (the state illustrated in FIG. 3A) from the drive wheel 52 to the drive pulley 51, and the torque-transmission state (the state illustrated in FIG. 3B) can be switched.

The detection lever 55 is supported to be rotatable to the support plate 59 by the support spindle 551 along the Z-axis direction, and is connected to the rotating body 56 through the support spindle 551, thereby performing rotation integrally with the support spindle 551 and the rotating body 56.

The detection lever 55 extends horizontally and is disposed such that the rotating end thereof can come in contact with the outer periphery of the thread wound around the bobbin B held by the bobbin winder spindle 53.

The rotating body 56 includes a protrusion 562 as a cam extending outwardly in the rotational radial direction and the detection piece 561. The protrusion 562 and the detection piece 561 are extended in opposite directions with respect to the support spindle 551.

The cam plate 58 extends in the same direction as the rotating arm 54, and rotates integrally with the rotating arm 54. One end of the cam plate 58 in pressed by a spring 591 supported to the support plate 59 in a direction in which the drive wheel 52 supported by the rotating arm 54 is separated from the drive pulley 51.

The cam plate 58 is formed with a recessed portion 581 into which the protrusion 562 of the rotating body 56 is fitted. As illustrated in FIG. 3A, when the protrusion 562 is fitted into the recessed portion 581, the drive wheel 52 is in the torque-cutting state in which the drive wheel is separated from the drive pulley 51.

In addition, the recessed portion 581 of the cam plate 58 includes a tilted portion so that the fitted protrusion 562 is released by the rotation of the rotating body 56. When the detection lever 55 is artificially rotated, it is possible to release the protrusion 562 from the recessed portion 581.

The protrusion 562 released from the recessed portion 581 comes in contact with the outer edge of the cam plate 58 at the tip end thereof, and rotates the cam plate 58 and the rotating arm 54, so that the drive wheel 52 can enter the torque-transmission state where the outer periphery of the drive wheel is in contact with the drive pulley 51, as illustrated in FIG. 3B. In this state, the tip end of the protrusion 562 is press-contacted to the outer edge of the cam plate 58 due to the pressing force of the spring 591, and the contacting state of the drive wheel 52 can be maintained due to friction between the press-contacted portions.

In addition, in the state illustrated in FIG. 3A, the detection piece 561 of the rotating body 56 is separated from a detector of the micro switch 57, and the micro switch 57 outputs an OFF signal.

On the other hand, in the state illustrated in FIG. 3B, the detection piece 561 presses the detector of the micro switch 57, and the micro switch 57 outputs an ON signal.

That is, when the empty bobbin B is set on the bobbin winder spindle 53, and the detection lever 55 is pushed inward the bobbin B, the state illustrated in FIG. 3B is achieved. Accordingly, the drive wheel 52 comes in contact with the drive pulley 51, a torque can be transmitted to the bobbin B from the upper shaft 33, and the micro switch 57 notifies the controller 90 of this state with the ON signal.

The controller 90 drives the motor 30 to rotate the upper shaft 33, the thread is wound around the bobbin B. When the outer diameter thereof reaches a prescribed size, the detection lever 55 is pushed back, and the protrusion 562 of the rotating body 56 slides on the tilted portion to fit into the recessed portion 581. Accordingly, the state illustrated in FIG. 3A is achieved, the drive wheel 52 is separated from the drive pulley 51, the rotation of the bobbin B is stopped, and the micro switch 57 notifies the controller 90 of this state with the OFF signal. The controller 90 stops the driving of the motor 30.

Control System of Sewing Machine

FIG. 4 illustrates a control system of the sewing machine 100.

The sewing machine 100 includes the controller 90 for controlling the operations of the respective configurations thereof, and the motor 30 serving as the drive source of stitching operation and an encoder 31 for detecting the output shaft angle (upper shaft angle) of the motor are connected to the controller 90 via a drive circuit 32.

Also, the cutting motor 431 of the above-described thread cutting device 43 is connected to the controller 90 via the drive circuit 432. Further, an image processing device 23 for performing predetermined image processes on data of images captured by the first and second cameras 21 and 22, and through an interface 571, the micro switch 57 of the bobbin thread winder 50 are connected to the controller 90.

In addition, an operation panel 41 as an operation unit performing operation input to the sewing machine by an operator of the sewing machine, a start button 42 to start stitching, and a pedal 44 for driving the motor 30 are connected to the controller 90 through respective interfaces (not shown).

For example, a stitch pitch which is the length of the seam for each stitch is set from the operation panel 41. A display unit is provided in the operation panel 41, and various kinds of information are displayed thereon The controller 90 mainly includes a CPU 91 performing control on the motor 30, an RAM 92 serving as an work area of the CPU 91, an ROM 93 stored with programs by which the CPU 91 processes, an EEPROM 94 serving as a storage unit configured to store data used in arithmetic processing, and to be capable of rewriting the data.

Calculation Process of Bobbin-Thread Winding Amount

During winding a thread on the bobbin B in a bobbin thread winder 50, the controller 90 performs a calculation process of a bobbin-thread winding amount.

Specifically, in a state where an empty bobbin B is set on the bobbin winder spindle 53 and a front end of a bobbin thread fed from the bobbin thread supply source is inserted into the slit formed in a central axis of the bobbin B, when the detection lever 55 rotates and is thrust into the bobbin B by a sewing worker 55, the drive wheel 52 comes into contact with the drive pulley 51, so that a torque can be transmitted from the upper shaft 33 to the bobbin B, and an ON signal is notified to the controller 90 from the micro switch 57 (a state illustrated in FIG. 3B).

At this time, the protrusion 562 of the rotating body 56 is released from the recessed portion 581 of the cam plate 58, the tip of the protrusion 562 is in contact with the outer edge of the cam plate 58 to cause the cam plate 58 and the rotating arm 54 to rotate, and the outer periphery of the drive wheel 52 is brought into contact with the drive pulley 51.

The CPU 91 of the controller 90 receives the ON signal notified from the micro switch 57 and starts driving the motor 30 in a direction reverse to the rotation direction at the time of sewing. Thus, a torque is applied from the upper shaft 33 to the drive pulley 51 through the one-way clutch 511, and the rotation is transmitted from the drive wheel 52 to the bobbin B.

In addition, the CPU 91 starts measuring a bobbin-thread winding execution time.

When the motor 30 is driven in the reverse rotation, the thread is wound around the central axis of the bobbin B, an outer diameter of the outer periphery of the bobbin thread becomes gradually larger, and the detection lever 55 is gradually pushed back.

When the outer diameter of the thread wound around the bobbin B reaches a prescribed size, the protrusion 562 of the rotating body 56 slides into the recessed portion 581 of the cam plate 58 to cause the cam plate 58 and the rotating arm 54 to rotate, and thus the drive wheel 52 is separated from the drive pulley 51.

Further, the detection piece 561 of the rotating body 56 separates from the micro switch 57, an OFF signal is notified from the micro switch 57 to the controller 90 (a state illustrated in FIG. 3A).

The CPU 91 of the controller 90 receives the OFF signal notified from the micro switch 57 and stops driving the motor 30.

Further, the CPU 91 calculates a bobbin-thread winding execution time based on the drive start to the stop of the motor 30. As described above, the CPU 91 of the controller 90 functions as the time measuring unit that measures the bobbin-thread winding execution time with respect to the bobbin B.

The bobbin-thread winding execution time measured in the thread winding operation of the bobbin B has a correlation with the bobbin-thread winding amount of the bobbin B, and the bobbin-thread winding amount of the bobbin B may be estimated only based on the bobbin-thread winding execution time.

However, since the bobbin-thread winding amount of the bobbin B also has a correlation with the outer diameter of the wound bobbin-thread, it is preferable to specify two parameter values of the bobbin-thread winding execution time and the outer diameter of the wound bobbin-thread in order to more accurately calculate the bobbin-thread winding amount (the total length of the thread wound around the bobbin B).

FIG. 5 illustrates a table for specifying the bobbin-thread winding amount based on outer diameter values of the thread wound around the bobbin B indicated in a vertical direction and bobbin-thread winding execution times indicated in a transverse direction. The controller 90 registers data of this table in an EEPROM 94. Then, the CPU 91 specifies the amount of the thread wound around the bobbin B from the table, based on the prescribed outer diameter size of the thread wound around the bobbin B at which the bobbin thread winder 50 finishes the thread winding and the bobbin-thread winding execution time which has been measured.

Then, the CPU 91 displays the amount of the thread wound around the bobbin B on a display portion of the operation panel 41.

Adjustment Control of Stitch Pitch

A stitch pitch adjusting control will be described below which is performed by the controller 90 of the sewing machine 100.

As described above, the sewing machine 100 is supported by the support base, and the sewing worker performs sewing while gripping a pair of handles 15 equipped on the left and right sides of the face portion and moving arbitrarily a position of a stitch point with respect to the cloth C supported horizontally on the support base.

In the stitch pitch adjusting control, the motor 30 controls the sewing machine 100, which is arbitrarily moved on the cloth C by the hand of the sewing machine operator, to perform the stitching at a constant stitch pitch set from the operation panel 41.

The CPU 91 of the controller 90 presses down the pedal 44 to start driving the motor 30.

Then, first and second camera 21 and 22 repeatedly capture an image of the cloth C at a prescribed cycle sufficiently shorter than the cycle of the vertical movement of the needle bar 13, and image signals are sequentially input to the image processing device 23.

In the image processing device 23, the captured image of the first camera 21 and the captured image of the second camera 22 are individually processed.

That is, the image processing device 23 extracts characteristic parts within the imaging range of the sequentially captured image, compares the extracted characteristic parts with characteristic parts of the immediately preceding captured image, and calculates the movement amount of the sewing machine 100.

Although the image processing device 23 calculates the movement amount of the sewing machine 100 based on each of the captured image of the first camera 21 and the captured image of the second camera 22, only the movement amount calculated based on any one of the cameras is generally employed. For example, when the captured image is not obtained by one camera under any image capturing obstacle, the movement amount is calculated based on the other camera.

Then, the CPU 91 calculates a moving speed of the sewing machine 100 based on the movement amount of the sewing machine 100 and the image capturing cycle, calculates a target rotation speed of the motor 30 for calculating the set stitch pitch based on the moving speed of the sewing machine 100 calculated every time, and controls the motor 30 to have the target rotation speed.

Thus, even when the sewing worker arbitrarily moves the sewing machine 100 to perform the sewing, the sewing can be performed at a constant stitch pitch.

Calculation Process of Amount of Residual Bobbin Thread

In addition, the CPU 91 of the controller 90 performs, at the time of the sewing, a calculation process of a residual bobbin thread in parallel with the stitch pitch adjusting control.

That is, when the sewing is started in the case where the sewing is executed in a state where the bobbin B wound with the thread in the calculation process of the bobbin-thread winding amount is set in the shuttle, the CPU 91 counts the number of stitches of the sewing machine 100 from the encoder 31 installed with the motor 30 and subtracts the length of the set stitch pitch based on the bobbin-thread winding amount, which is calculated in the calculation process of the bobbin-thread winding amount, for each stitch. Since the subtraction value is the amount of bobbin thread remaining on the bobbin B, the CPU 91 displays the calculated amount of bobbin thread remaining on the bobbin B on the display portion of the operation panel 41.

The amount of bobbin thread remaining on the bobbin B may be updated and displayed for each stitch, but the amount of bobbin thread remaining on the bobbin B may be updated and displayed for plural stitches in consideration of the difficulty in reading the numerical value.

In addition, the display may be updated every time the amount of residual bobbin thread is reduced by a certain numerical unit.

Alternatively, when the amount of residual bobbin thread is below a prescribed lower limit value, a notification that the amount of residual bobbin thread is none is displayed.

Technical Effects of Embodiment of the Invention

The bobbin thread winder 50 of the sewing machine 100 includes the bobbin winder spindle 53 holding the bobbin B, the drive pulley 51 and the drive wheel 52 which serve as a driving mechanism and apply a rotational force to the bobbin winder spindle 53, and the detection lever 55 and the micro switch 57 which serve as a bobbin-thread outer diameter detecting unit for detecting that the outer diameter of the thread wound around the bobbin B held on the bobbin winder spindle 53 reaches a prescribed size, and the CPU 91 of the controller 90 functions as the bobbin-thread winding amount calculating unit that calculates the bobbin-thread winding amount of the bobbin based on the bobbin-thread winding execution time on the bobbin B until the outer diameter of the thread wound around the bobbin B reaches the prescribed size, whereby it is possible to more accurately detect the bobbin-thread winding amount of the bobbin B regardless of the type and the thickness of the bobbin thread.

Further, it is not necessary for the sewing worker to estimate the bobbin-thread winding amount of the bobbin B based on the outer diameter of the thread wound around the bobbin B and the type and thickness of the bobbin thread or to input the estimated value to the sewing machine, and it is possible to reduce the burden on the work of the sewing worker.

In the sewing machine 100, the CPU 91 functions as a bobbin-thread remaining amount calculating unit for calculating the amount of bobbin thread remaining on the bobbin B from the bobbin-thread winding amount of the bobbin B calculated in the calculation process of the bobbin-thread winding amount and the set stitch pitch at the time of the sewing.

Accordingly, the sewing worker of the sewing machine can constantly grasp the residual amount of the bobbin thread at the time of the sewing and can easily avoid the occurrence of stitching interruption, so that it is possible to reduce the occurrence of waste of the cloth and to reduce the burden to begin again the work.

Others

In the calculation process of the bobbin-thread winding amount, the case is exemplified in which the bobbin-thread winding amount is calculated based on the table data using the outer diameter of the thread wound around the bobbin B and the bobbin-thread winding execution time as a parameter. However, when the outer diameter of the thread wound around the bobbin B always has the prescribed value as in the bobbin thread winder 50, table data using only the bobbin-thread winding execution time as a parameter may be used.

Figure 6:
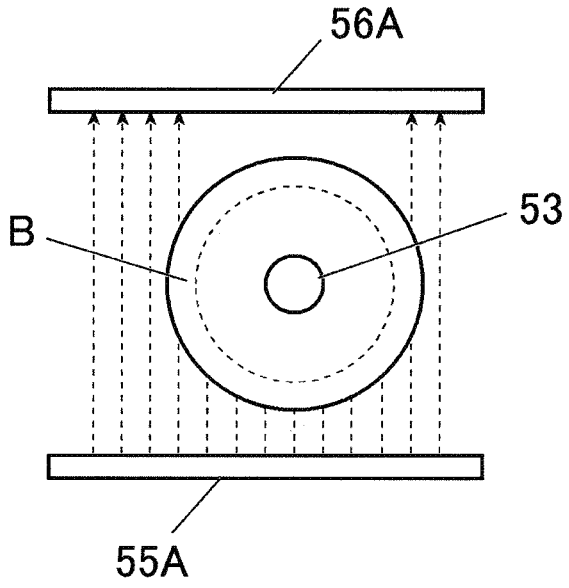
FIG. 6 is a plan view illustrating a bobbin-thread outer diameter detecting unit.

Further, as illustrated in FIG. 6, a bobbin-thread outer diameter detecting portion may be provided which includes a light source 55A for irradiating the bobbin B held on the bobbin winder spindle 53 with detection light being parallel in a horizontal direction in a range of the entire bobbin width or more and a line sensor 56A for receiving the detection light in an arrangement sandwiching the bobbin B and detects the outer diameter of the thread wound around the bobbin B from the width of the detection light shielded by the thread wound around the bobbin B.

In the configuration of the bobbin-thread outer diameter detecting portion, it is possible to detect the change in the outer diameter of the bobbin thread in real time while the thread is being wound around the bobbin B.

Therefore, for example, during the bobbin-thread winding execution, the CPU 91 may periodically detect the outer diameter of the thread wound around the bobbin B from the bobbin-thread outer diameter detecting portion, measure the bobbin-thread winding execution time, and periodically detect the amount of thread wound on the bobbin B with reference to the above-described table data from these two parameters.

Thus, it is possible to perform the bobbin-thread winding on the bobbin B with a certain amount by setting a target bobbin-thread winding amount necessary for the bobbin B in advance and stopping motor 30 at the time when the bobbin-thread winding amount reaches the target bobbin-thread winding amount by the periodic detection.

Alternatively, control may be performed to periodically detect the amount of thread wound around the bobbin B and periodically and sequentially display the detected bobbin-thread winding amount on the display portion of the operation panel 41. In this case, it is preferable to include an input portion to which the sewing worker arbitrarily inputs a stop operation of the bobbin-thread winding while watching the detected bobbin-thread winding amount on the display portion of the operation panel 41.

The calculation process of the bobbin-thread winding amount using the controller 90 and the bobbin thread winder 50 is not limited to the sewing machine that performs free motion sewing, but can also be applied to any kind of sewing machine including a bobbin thread winder.

The calculation process of the residual bobbin thread is not limited to the sewing machine that performs free motion sewing, but can also be applied to any kind of sewing machine capable of detecting the movement amount of every stitch point.

The invention claimed is:

1. A bobbin thread winder of a sewing machine including a bobbin winder spindle holding a bobbin and a driving mechanism to apply a drive force to the bobbin winder spindle, comprising:

a time measuring unit configured to measure a total bobbin-thread winding execution time with respect to the bobbin;

a bobbin-thread winding amount calculating unit configured to calculate a winding amount of the bobbin based on the bobbin-thread winding execution time with respect to the bobbin measured by the time measuring unit; and a bobbin-thread outer diameter detecting unit configured to detect that an outer diameter of the thread wound around the bobbin held by the bobbin winder spindle reaches a prescribed size, wherein the bobbin-thread winding amount calculating unit is configured to calculate a bobbin-thread winding amount of the bobbin from the bobbin-thread winding execution time with respect to the bobbin during which the bobbin-thread outer diameter detecting unit detects that the outer diameter of the bobbin thread reaches the prescribed size.

2. The bobbin thread winder of a sewing machine according to claim 1, further comprising:

a bobbin-thread remaining amount calculating unit configured to calculate the bobbin-thread remaining amount of the bobbin based on the bobbin-thread winding amount of the bobbin calculated by the bobbin-thread winding amount calculating unit, and a stitch pitch set in advance.

3. A bobbin thread winder of a sewing machine including a bobbin winder spindle holding a bobbin and a driving mechanism to apply a drive force to the bobbin winder spindle, comprising:

a time measuring unit configured to measure a total bobbin-thread winding execution time with respect to the bobbin;

a bobbin-thread winding amount calculating unit configured to calculate a winding amount of the bobbin based on the bobbin-thread winding execution time with respect to the bobbin measured by the time measuring unit; and a bobbin-thread outer diameter detecting unit configured to detect an outer diameter of the thread wound around the bobbin, wherein the bobbin-thread winding amount calculating unit is configured to calculate a bobbin-thread winding amount of the bobbin from the outer diameter of the thread wound around the bobbin detected by the bobbin-thread outer diameter detecting unit, and from the bobbin-thread winding execution time with respect to the bobbin.

4. The bobbin thread winder of a sewing machine according to claim 3, further comprising:

a bobbin-thread remaining amount calculating unit configured to calculate the bobbin-thread remaining amount of the bobbin based on the bobbin-thread winding amount of the bobbin calculated by the bobbin-thread winding amount calculating unit, and a stitch pitch set in advance.

* * * * *